United States Patent [19]

Barr

[11] 4,122,621

[45] Oct. 31, 1978

[54] UNDERWATER REPEATING SPEAR GUN

[76] Inventor: W. Lincoln Barr, 314 S. 9th, Kingfisher, Okla. 73750

[21] Appl. No.: 815,668

[22] Filed: Jul. 14, 1977

[51] Int. Cl.[2] ..... F41C 3/00; F41F 1/00

[52] U.S. Cl. ..... 42/1 L

[58] Field of Search ..... 42/1L; 102/48

[56] References Cited

U.S. PATENT DOCUMENTS

| | | | |
|---|---|---|---|
| 3,161,976 | 12/1964 | Lambert | 42/1 L |
| 3,453,763 | 7/1969 | Barr et al. | 42/1 L |
| 3,616,561 | 11/1971 | Hendricks | 42/1 L |
| 3,729,853 | 5/1973 | Critcher | 42/1 L |

*Primary Examiner*—Charles T. Jordan
*Attorney, Agent, or Firm*—Dunlap, Codding & McCarthy

[57] ABSTRACT

A repeating spear gun for firing self-propelled spears, the spear gun having a magazine comprising a plurality of spear firing chambers disposed as radial sets of firing chambers, and a bolt having a plurality of firing pins, each firing pin aligned with a firing chamber in the firing path of the bolt. The firing pins are staggered to provide varying firing pin distances to the respective firing chambers positioned in the firing path of the bolt. The firing pins are thereby caused to arrive at the respective firing chambers at different times, and if a spear occupies the firing chamber nearest the bolt, the spear is launched and the exhaust gas therefrom brakes the bolt to prevent firing of a spear contained in another firing chamber. If the firing chamber nearest the bolt is unoccupied, another firing pin will ignitingly impact a spear disposed in another firing chamber of the radial set.

12 Claims, 4 Drawing Figures

UNDERWATER REPEATING SPEAR GUN

BACKGROUND OF THE INVENTION

1. Field of the Invention

This invention relates generally to repeating small arms and more particularly, but not by way of limitation, to a repeating spear gun for use in an underwater environment.

2. Brief Description of the Prior Art

The utility of a multi-shot capability in a firearm is well known, and numerous patents have been issued for repeating weapons of various types. The convenience and added protection associated with repeating land weapons are equally desirable in a weapon designed for use in a marine environment. A diver is subjected to dangers which can be met by personal sidearms to no less an extent than a person in a land area containing various species of wild animals.

Th optimum capacity of a firearm is related to a number of factors. These factors include the inconvenience of reloading, the increased bulk required as the capacity of the weapon is increased, the mechanical complexity required to increase the capacity, and the quantity of ammunition the user can carry. In a land weapon, the number of cartridges that can be carried and the ease of reloading are such that it is generally not a great advantage to provide the weapon with a large capacity. Reloading will be required in any event to use the quantity of ammunition the user can conveniently carry, and the complexity of a weapon and the bulk necessary to provide the weapon with a large capacity often militate against providing for large capacities in the design of land weapons.

A different situation obtains if the weapon is to be used underwater. Ammunition suitable for use underwater is usually considerably bulkier than ammunition used on land; spears are generally used in an underwater environment to avoid range limitations encountered when bullets and the like are fired underwater. As a result, the user of such a weapon is more limited in the amount of ammunition he can carry than is the user of a land weapon. Moreover, rapid and precise movements underwater are more difficult than on land, particularly where the diver must wear gloves, a situation which often occurs. Accordingly, reloading is a more difficult task so that an increase in bulk which would be unacceptable in a land weapon is an acceptable alternative to multiple reloading of an underwater weapon. By providing the weapon with a large capacity, the number of times a diver must reload to exhaust his supply of ammunition may be reduced with only a relatively small increase in the bulk and complexity of the weapon.

It has long been recognized that the capacity of a revolver type firearm may be increased by providing the cylinder thereof with more than one set of chambers and means for selecting the set of chambers to be fired when the firing mechanism of the revolver is actuated. A number of weapons of this type have been patented for use on land. While the principal of multiple sets of chambers is viable in an underwater weapon, the problem of adapting such a system to underwater use has heretofore not been solved.

SUMMARY OF THE INVENTION

The present invention comprises a breech and a magazine that is removably attachable to the breech, the magazine having a plurality of firing chambers. The firing chambers are arranged in radial sets of primary and auxiliary firing chambers, and the radial sets of firing chambers are sequentially positioned in a firing position. Self propelled spears are positionable in the firing chambers in a launching position therein.

A bolt having a primary firing pin and an auxiliary firing pin is movably supported by the breech, and a biasing means is provided for forcefully urge the bolt in a firing path toward the radial set of firing chambers that is positioned in the firing position. When the bolt is in a rest position, the distances between the firing pins with respect to the respective launching positions of the firing tubes vary such that the primary and auxiliary firing pins arrive at the launching positions at different times. Consequently, if a spear is disposed in the primary firing tube that is located at the firing position, the primary firing pin ignitingly impacts that spear, and the force of the impact plus the reaction force of the spear propulsion gas brake the movement of the bolt by a sufficient magnitude to prevent the auxiliary firing pin to ignitingly impact a spear in the respective auxiliary firing chamber that is positioned in the firing path. On the other hand, absent a spear in the primary firing chamber, the auxiliary firing pin will ignitingly impact a spear in the auxiliary firing chamber.

In the preferred embodiment, the spear gun is provided with an indexing mechanism to rotate the magazine so that successive launching of spears via the actuation of the spear gun will cause spears disposed in the primary firing chambers to be launched first, followed by successive launching of spears in the auxiliary firing chambers until all spears have been launched.

Accordingly, an object of this invention is to provide an underwater weapon having the capability for firing a plurality of spears prior to the need for reloading.

A further object of the invention is to provide a repeating spear gun having a simple mechanism for sequencing the order in which the spears are launched.

Another object of the invention is to utilize the exhaust gas from self propelled spears to sequence the firing order of spears in an underwater weapon.

Still a further object of the invention is to provide a spear gun with a plurality of firing pins that are mounted on longitudinally staggered reaction faces of a bolt in order to launch spears disposed in a magazine comprising a plurality of firing chambers.

Other objects, advantages and features of the invention will become clear by reading the following detailed description of the embodiments along with the drawings and appended claims.

BRIEF DESCRIPTION OF THE DRAWINGS

FIG. 4 is identical to FIG. 3 with the exception that the embodiment of FIG. 4 has an independent firing pin mechanism associated with the axial firing chamber.

DESCRIPTION OF THE EMBODIMENT OF FIGS. 1-3

Figure 1:
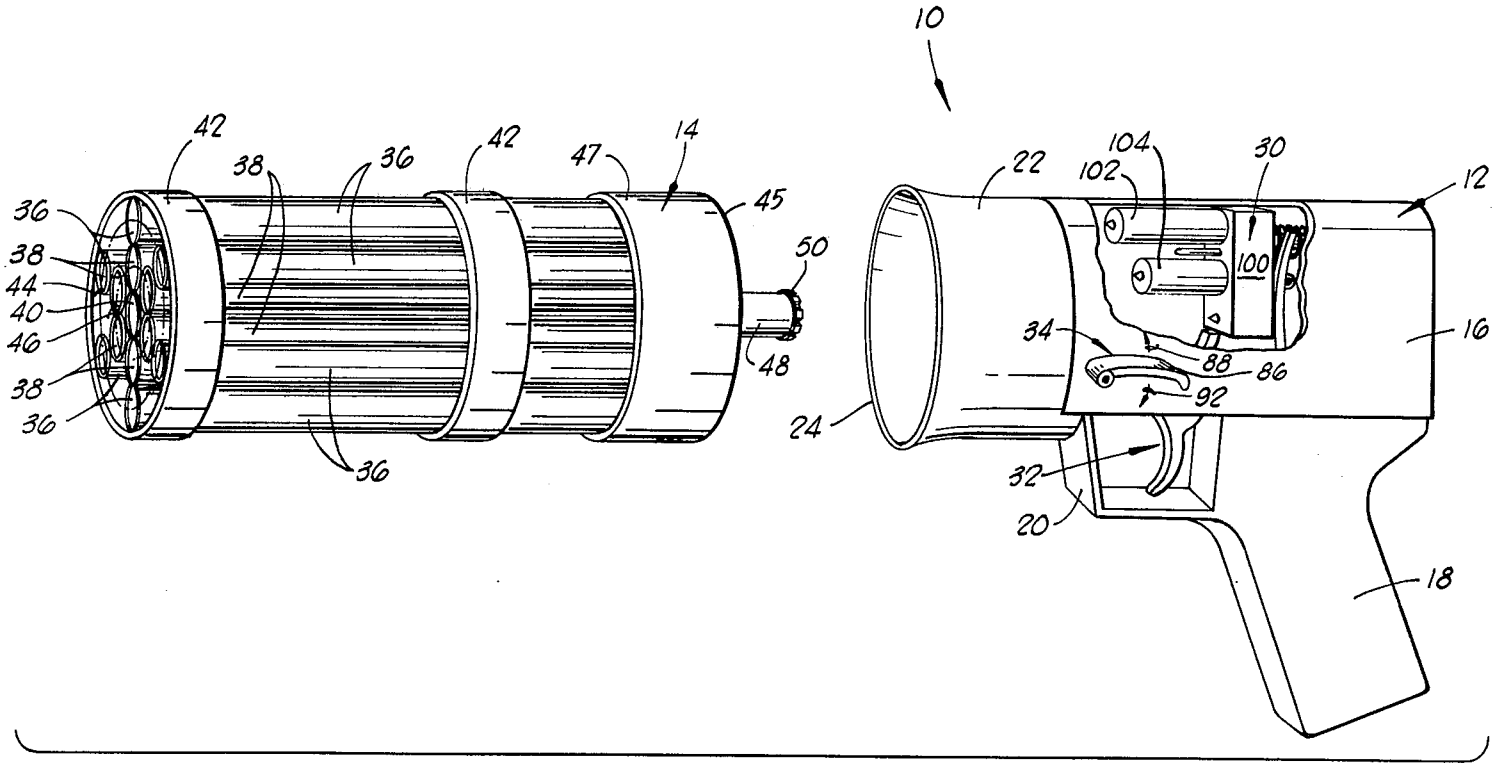
FIG. 1 is a perspective view of the spear gun of the present invention, showing a partial cutaway of the breech and showing the magazine as being removed from the breech. The magazine is shown in reduced length to accommodate the drawing limitations.

Referring to the drawings in general and specifically to FIG. 1, shown therein is a spear gun 10 constructed in accordance with the present invention. The spear gun 10 comprises a breech assembly 12 and a magazine 14 that is shown removed from the breech 12 in FIG. 1.

The breech 12 forms the housing and general frame support for the spear gun 10, and comprises a housing 16, a handle member 18 and a trigger guard 20. The forward end of the housing 16 is shaped as a cylindrically formed magazine support member 22. The outer end 24 of the magazine support member 22 is flared for a purpose that will be made clear below.

Disposed within the breech assembly 12 and supported thereby is a bolt assembly 30 and a trigger assembly 32. Also, the breech assembly 12 supports a magazine retainer assembly 34.

The magazine 14 is shown in a disassembled mode in FIG. 1. That is, the magazine 14 is shown removed from the breech assembly 12. The magazine 14 comprises a launching tube assembly that has a plurality of launching tubes that will also be referred to herein as firing chambers. As shown in FIG. 1, the magazine 14 has a plurality of launching tubes that will also be referred to herein as firing chambers. As shown in FIG. 1, the magazine 14 has a plurality of firing chambers 36 and a plurality of firing chambers 38. The firing chambers 36 and 38 are long cylindrical shaped, rigid tubes that are disposed about an axial firing chamber 40. The firing chambers 36, 38 and 40 collectively form a bundle of launching tubes that are held together by a number of retaining bands 42 and by other attaching means (such as brazing or welding) that join together adjacent launching tubes.

The firing chambers 36 are arranged to have their axial centers located on an outer ring 44 that is concentric with the axial chamber 40. In like manner, the firing chambers 38 are disposed such that their axial centers are located on an inner ring 46 that is concentric with the axial chamber 40. All of the firing chambers 36, 38 and 40 of the magazine 14 have their axial centers parallel to each other, such that this outer and inner ring arrangement is maintained throughout the length of the firing chambers. As to the actual length of the launching tubes of firing chambers, this may vary according to the length of spear that is used in the spear gun 10, but generally speaking, the length of the individual launching tubes will usually be somewhere between one to four feet in length.

The firing chambers 36 in the outer ring 44 will also be referred to herein as primary firing chambers, while the firing chambers 38 in the inner ring will also be referred to herein as auxiliary firing chambers. It will be noted by reference to FIG. 1 that the primary firing chambers 36 and the auxiliary firing chambers 38 are disposed radially such that each one of the firing chambers 36 together with its respectively adjacent auxiliary firing chamber 38 form a radial set of firing chambers. It should also be noted that the axial firing chamber 40, being at the center of the magazine 14, is aligned with each radial set of primary and auxiliary firing chambers.

At the rear end 45 of the magazine 14, a breech engaging band 47 is disposed about the firing chambers 36 and serves as a retaining band in the same fashion as the bands 42. Also, the outer diameter of the breech engaging band 47 is sized so as to be rotatingly supported by the internal diameter of the magazine support member 22 of the breech assembly 12. The reason for this is that the magazine support member 22 provides a supporting bearing for the breech engaging band 47, and the outer end 24 of the magazine support member 22 is flared to provide ease of insertion of the breech engaging band 47 within the magazine support member 22.

It will be noted that the axial firing chamber 40 is of greater length than the primary firing chambers 36 and the auxiliary firing chambers 38, having a portion 48 that extends beyond the rear end 45 of the magazine 14. An indexing gear 50, having a bore (not shown) formed therethrough and sized to mate with the external diameter of the firing chamber 40, is mounted on the protruding end of the portion 48 and extends circumferentially thereabout. The purpose of the indexing gear will be explained below.

Figure 2:
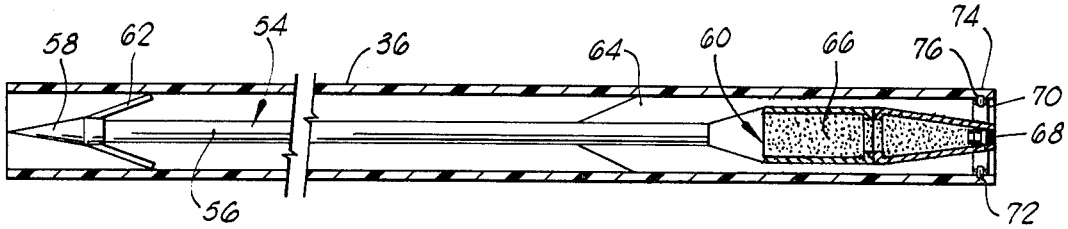
FIG. 2 is a partial cross section of a firing chamber having a spear disposed in a launching position in the firing chamber.

Shown in FIG. 2 is a cross sectional view of a firing chamber 36 that is also representative of the firing chambers 38 and 40 as well. Also shown in FIG. 2 is a self propelled spear 54 that is disposed in the firing chamber 36 at a launching position therein.

The spear 54 is largely conventional with the exception that will be herein described. The spear 54 has a shaft portion 56 that has a pointed spear head 58 connected at one of its ends and a propulsion unit 60 connected to its other end. The spear has a set of frontal barbs 62 that lodge the spear in a target and a set of rear fins 64 that serve to stabilize the spear 54 in its propelled flight through the water or the like. The propulsion unit 60 has a diameter slightly smaller than the diameter of the bore of the firing chamber 36 to facilitate passage of the spear 54 through the firing chamber 36 when the firing chamber 36 is filled with water and the propulsion unit 60 has a propelling charge 66 that is ignitable by a primer 68 disposed at the rear end of the spear 54. The structure of such spears being conventional, further detail need not be given as to the construction of the spear 54 with the exception of the spear retaining means that will now be described.

The spear 54 has a ring support member 70 located near the rear end of the spear. The ring support member 70 serves as a support for a spear retaining ring 72. The spear retaining ring 72 may be an O-ring, or a split ring, the outer diameter of which is somewhat larger than the internal diameter of the firing chamber 36. Near the rear end 74 of the firing chamber 36 is a beveled relief ring 76 disposed in the internal surface of the firing chamber 36. The external dimensions of the spear 54 are sizingly determined such that the spear 54 is freely passable through the bore of the firing chamber 36 with the exception that the outer diameter of the retaining ring 72 is sized to be supported by the ring support member 70 such that the retaining ring 72 is caused to rub against the internal wall of the firing chamber 36. That is, the retaining ring 72 offers a slight resistance to the passage of the spear 54 through the bore of the firing chamber 36. The relief ring 76 is provided for the purpose of defining a launching position for the spear 54, and the position of the relief ring 76 is located such that the primer 68 of the spear 54 is disposed substantially at the rear end 74 of the firing chamber 36 in the loaded condition thereof. As the spear 54 is placed in the firing chamber 36 from the rear 74 thereof, the spear 54 will freely enter the bore of the firing chamber 36 until the retaining ring 72 engages the internal wall of the firing chamber, and a small amount of added force will cause the spear to continue entering the bore of the firing chamber 36 until the retaining ring 72 is seated in the relief ring 76, which will provide a distinct feel to the person loading the firing chamber.

Figure 3:
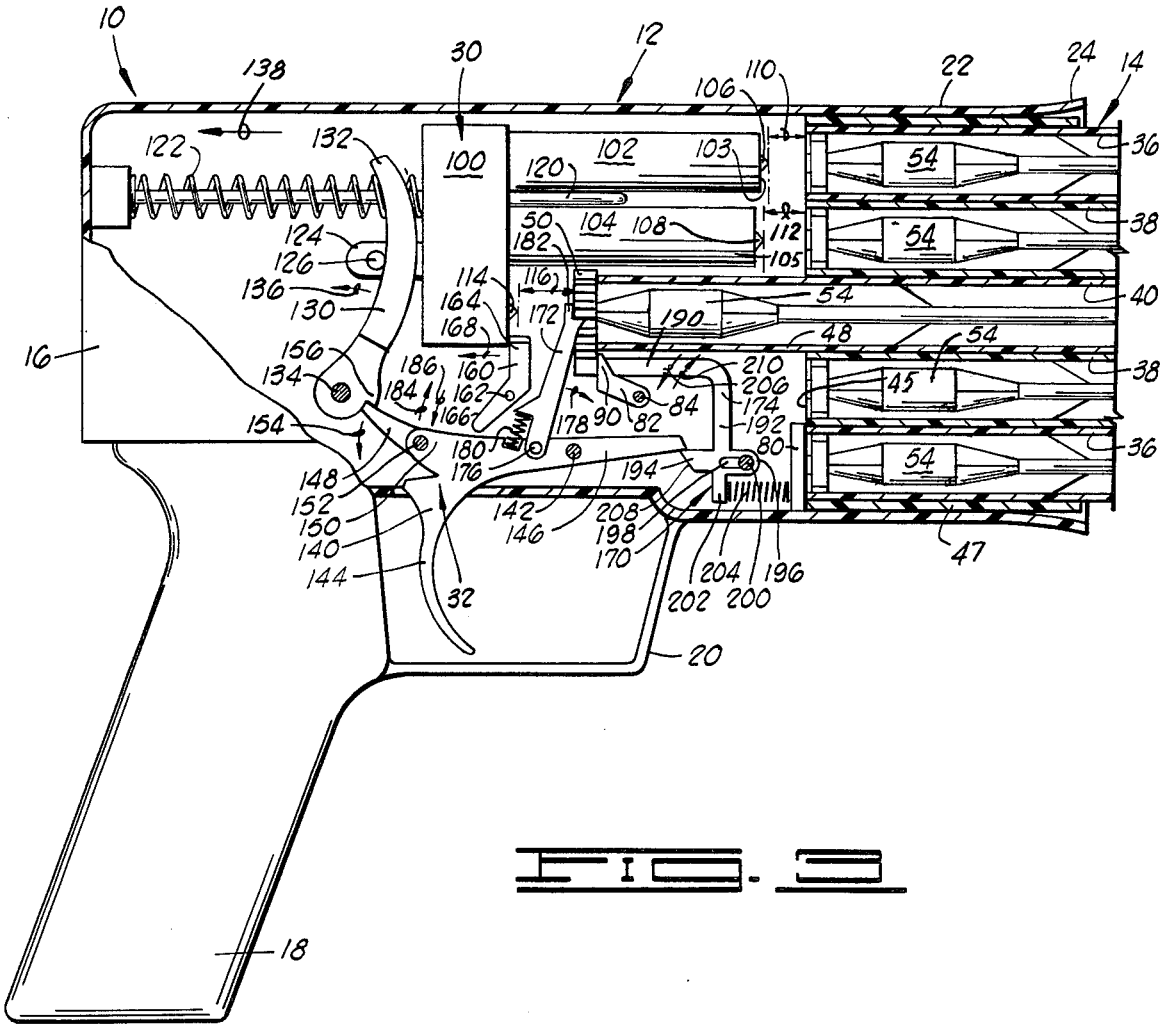
FIG. 3 is an elevational view of one side of the spear gun of FIG. 1 in partial cutaway view. The magazine is loaded in the breech of the spear gun and is shown in partial, cutaway view.

Turning now to FIG. 3, shown therein is the spear gun 10 in its assembled mode. That is, FIG. 3 shows a partial cross sectional view of the spear gun 10 having the magazine 14 loaded in the magazine support member 22 of the breech assembly 12. This view clearly shows the position that the spears 54 assume relative to the breech assembly 12 when the spears 54 are loaded in the various firing chambers 36, 38 and 40 in the launching positions therein. It should be noted that the spear 54 that is loaded in the axial firing chamber 40 is partially contained in the axial firing chamber portion 48.

The rear end 45 of the magazine 14 abuts against a guiding tab 80 which is supported by the housing 16, and the launching position of each of the spears 54 is arranged within the various firing chambers 36 and 38 such that the primers 68 clearingly pass the guide tab 80.

The magazine 14 is retainingly attached to the breech assembly 12 via the magazine retaining assembly 34 which comprises a forked retaining member 82 that is pivotally supported between the sidewalls of the housing 16 via a support shaft 84. The support shaft 84 is supported in bearings (not shown) supported by the sidewalls of the housing 16, and one end of the support shaft 84 extends through and is connected to a release lever 86 that is shown in FIG. 1. An axially loaded spring (not shown) or the like biases the retaining member 82 in the pivotal direction 88, and a stop member (not shown) positions the retaining member 82 normally in that position shown in FIG. 3. The tines 90 of the retaining member 82 are spaced apart so as to cradle the axial firing chamber portion 48 just behind the indexing gear 50 as shown in FIG. 3. A movement of the release lever 86 in the direction 92 (FIG. 1) will pivot the retaining member 82 such that the tines 90 thereof clear the indexing gear 50 so that the magazine 14 may be removed from the breech assembly 12. Conversely, when the breech engaging band 47 of the magazine 14 is inserted in the magazine support member 22, the axial firing chamber portion 48 will push the indexing gear 50 against the tines 90 of the retaining member 82 until the indexing gear 50 has been moved sufficiently inward in the housing 16 so that the spring of the retaining member 82 seats the tines 90 behind the indexing gear 50.

Turning now to the bolt assembly 30, FIG. 3 shows the bolt assembly 30 disposed within the housing 16 and slidably supported by guide members (not shown) along the inner walls of the housing 16. The bolt assembly 30 comprises a bolt 100 that has an extending portion 102 and an extending portion 104. The extending members 102, having an end 103, and 104, having an end 105, are cylindrically shaped members that are sized to be receivable within the firing chambers 36 and 38 that comprise the radial set of firing chambers within the firing path of the bolt 100. As will be explained below, the ends 103 and 105 of the extending members 102 and 104, respectively, serve as reaction faces against which propulsion gases of ignited spears react to brake the firing motion of the bolt 100.

A primary firing pin 106 is disposed on the end 103 of the extending portion 102 of the bolt 100, and an auxiliary firing pin 108 is disposed on the end 105 of the extending portion 104. In the rest position of the bolt 100 as shown in FIG. 3, the primary firing pin 106 is positioned to be a first firing pin distance 110 from the primer of the spear 54 in the launching position of the primary firing chamber 36 that is disposed in the firing path of the bolt 100. In like manner, the auxiliary firing pin 108 is positioned a second firing pin distance 112 from the primer of the spear 54 disposed in the auxiliary firing chamber 38 that is positioned in the firing path of the bolt 100 in its rest position. An axial firing pin 114 is supported on the bolt 100 and is positioned a third firing pin distance 116 from the primer of the spear 54 that is disposed in the axial firing chamber of the magazine 14 in the assembled mode thereof. For a reason that will be explained below, the third firing pin distance 116 is greater than the second firing pin distance 112, and the second firing pin distance 112 is greater than the first firing pin distance 110.

The bolt 100 has a bore therethrough and is partially supported and guided by a guide pin 120 that extends from the rear wall of the housing 16, and a coil spring 122 is positioned about the guide pin 120 as shown in FIG. 3. A tab member 124 extends from the bolt 100 and supports a transverse pin 126.

The trigger assembly 32 includes an activating lever 130 that serves to move the bolt 100 from its rest position against the coil spring 122 to a firing position. The activating lever 130 having a pair of tines 132 (one of which is viewable in FIG. 3) is pivotally supported on the support end 134 that is supported at its ends by the side walls of the housing 16. The tines 132 are curved and are disposed to cradle the tab 124 such that pivotation of the activating lever 130 in the direction 136 about the pin 134 causes the tines 132 to bear against the transverse pin 126 to move the bolt 100 in the direction 138.

The trigger assembly 32 also comprises a trigger member 140 that is pivotally supported by the housing 16 of the breech assembly 12 via a staked pivot pin 142. The trigger member comprises a finger portion 144 and an indexing portion 146 disposed on opposing sides of the pivot pin 142 as shown in FIG. 3. A spring loaded spur or sear member 148 is pivotally attached to an extending finger portion 150 of the finger portion 144 via a pivoting connecting pin 152. An axial spring (not shown) biases the spur member 148 to rotate in the direction 154, and a shoulder stop member (not shown) restricts the rotation of the spur member 148 such that the spur member 148 assumes the position shown in FIG. 3 when the bolt 100 is in the rest position. The spur member 148 engages a cam shoulder 156 that extends as a portion of the activating lever 130.

The trigger assembly 32 also comprises a bolt return member 160 that is pivotally supported by a staked pin member 162 that is attached between the sidewalls of the housing 16. The bolt return member 160 has a bolt engaging portion 164 and a trigger engaging portion 166 on opposing sides of the pivoting support pin 162. An axial spring (not shown) biases the bolt return member 160 to rotate in the direction 168, and the bolt return member 160 assumes the position shown in FIG. 3 when the bolt 100 is in the rest position, with the bolt engaging portion 164 engaging the bolt 100, and the trigger engaging portion 166 engagingly contacting the finger portion 144 of the trigger 140.

The spear gun 10 also has a chamber indexing assembly 170 that is responsive to the trigger assembly 32 for rotating the magazine 14 to automatically and sequentially position the primary firing chambers 36 and the auxiliary firing chambers 38 in the firing path of the bolt 100. The indexing gear 50 connected to the axial firing chamber 40, as described above, forms a portion of the chamber indexing assembly 170. Further portions of the chamber indexing assembly are the gear engaging member 172 and the locking bar member or pawl member 174.

The gear engaging member 172 is pivotally connected to the trigger member 140 via the pivot pin 176 and is biased to rotate in the direction 178 by the spring 180. A stop member (not shown) restricts the movement of the gear engaging member 172 to approximately the position shown in FIG. 3. The distal end 182 of the gear engaging member 172 springingly engages the indexing gear 50 such that rotation of the trigger 140 in the direction 184 will cause the gear engaging member 172 to rotate the magazine 14 via the engagement of the distal end 182 and the indexing gear 50. A trigger return spring (not shown) biases the trigger 140 in the opposite direction 186, and as the trigger 140 is pivoted in the direction 186 on its return after firing engagement, the gear engaging member 172 rotates slightly against the spring 180 to bypass a gear tooth of the indexing gear 50 in a ratchet manner to once again assume the position shown in FIG. 3.

The locking bar 174 as indicated above serves as a pawl member to retain the magazine 14 in a selected position except when the magazine 14 is being indexed via the gear engaging member 172 and the indexing gear 50 as described above. The locking bar 174 is generally L-shaped having a gear engaging portion 190 that extends generally parallel to the axial firing chamber 40, and a support portion 192 that is connected to the gear engaging member 190. The support portion 192 has a trigger engaging shoulder 194 and a bolt engaging shoulder 196. A slot 198 is formed in the support portion 192 generally in the bolt engaging shoulder 196. A support pin 200 that is connected to the housing 16 is disposed through the slot 198 and serves to support the locking bar member in a manner that permits pivoting and sliding movement thereof. The distal end 202 of the support portion 192 is attached to a coil spring 204 that is in turn attached to the guide tab 80 that extends from the housing 16 as was described above.

When the trigger 140 is caused to be moved in the pivoting direction 184 (in firing the spear gun 10), the indexing portion 146 bears against the trigger engaging shoulder 194 to effect the rotation of the locking bar member 174 about the pin 200 in an unlocking direction 206. The trigger engaging shoulder 194 has a sloped surface 208, and the trigger engaging shoulder 194 is shaped such that sufficient rotation of the trigger 140 in the direction 184 causes the indexing portion 146 to separate from and pass the shoulder portion 194. When this occurs, the coil spring 204 causes the locking bar member 174 to pivot in the locking direction 210 so that the shoulder portion 194 is above the indexing portion 146 of the trigger 140, and the gear engaging portion 190 of the locking bar member 174 is in locking engagement with the indexing gear 50. That is, the actuation of the trigger 140 to first move in the direction 184 followed by movement of the trigger 140 in the reversed direction 186 causes two things to occur: the locking bar member 174 is caused to disengage the indexing gear 50 while the gear engaging member 172 is caused to effect the rotation of the indexing gear 50 while the trigger 140 is moved in the direction 184; and the locking bar member 174 once released from engagement with the trigger 140 again is brought into locking engagement with the indexing gear 50, and the gear engaging member 172 is pivoted clear of the gear teeth of the indexing gear 50 until it once again gearingly engages the indexing gear 50 when the trigger is returned to the position shown in FIG. 3. So that the trigger engaging portion 146 can clear the trigger engaging shoulder 194 as the trigger 140 is returned via rotation in the direction 186, the trigger engaging portion 146 bears against the sloped surface 208 of the trigger engaging shoulder 194 to slide the locking bar member 174 via the slot 198 on the pin 200. Once the indexing portion 146 of the trigger 140 has moved past the trigger engaging shoulder 194, the coil spring 204 causes the locking bar member 174 to return to the position shown in FIG. 3.

OPERATION OF THE EMBODIMENT OF FIGS. 1–3

The description to this point in the disclosure has indicated that the magazine or launching tube assembly 14 is rotatably supported by the breech 12 in an assembled mode of the spear gun 10. The magazine 14 comprises a plurality of firing tubes that are disposed as primary firing tubes 36, auxiliary firing tubes 38 and an axial firing tube 40, with one each of the primary firing tubes 36 and the auxiliary firing tubes 38 arranged to be paired as radial sets of firing chambers. At any given time, one radial set of firing chambers comprising one of the primary firing tubes 36 and one of the auxiliary firing tubes 38 is positioned in a firing position; that is, one radial set of firing chambers is positioned in the firing path of the bolt 100 at any given time. Of course, the axial firing chamber 40 is always positioned in the firing path of the bolt 100 since the magazine 14 is caused to rotate about its axial center that is also the axial center of the axial firing chamber 40.

Each firing chamber has a rear end disposed substantially adjacent the breech 12 in the assembled mode of the spear gun 10, and each firing chamber contains in a loaded condition thereof a spear 54 having a propulsion mechanism positioned substantially adjacent the rear end of the firing tube such that each of the spears is in a launching position in its respective firing chamber. It is clear that at least two of the firing chambers 36, 38 (that is, a radial set of firing chambers) are positioned simultaneously in the firing position.

Assuming that the spear gun 10 is in the assembled mode and that the magazine 14 is loaded with an appropriate number of spears 54 corresponding to the number of firing chambers of the magazine 14, the initial actuation of the trigger 140 will cause the bolt 100 to ignitingly impact a spear 54 in one of the primary firing chambers 36 as follows. As the trigger 140 is caused to be rotated in the direction 184, the spur member 148 connected thereto will engage the cam shoulder 156 of the activating lever 130 which will effect the rotation of the activating lever 130 about the support pin 134, causing the tines 132 to engage the transverse pin 126 of the tab 124 that extends from the bolt 100, and the bolt 100 will thereby be caused to be moved on the guide pin 120 to compress the coil spring 122. As the trigger 140 continues to rotate in the direction 184, the transverse pin 126 will be caused to move along the curvature of the tines 132 until the trigger 140 is moved far enough that the spur member 148 clears the cam shoulder 156. At this position, the bolt 100 has been moved to its firing position, and the clearance of the spur member 148 with the cam shoulder 156 releases the bolt 100 to be forcefully urged by the coil spring 122 toward the propulsion mechanisms of the spears 54 that are in the firing position.

While the trigger 140 is being pivoted in the direction 184 to retract the bolt 100 to its firing position, the chamber indexing assembly 170 has rotated the magazine 14 to place a radial set of firing chambers in the firing path of the bolt 100, with this action having been completed prior to the time that the bolt 100 has reached its firing position and prior to the release of the bolt 100 by the spur member 148. The operation of the chamber indexing assembly 170 has been discussed above, and it is not believed necessary to add further description at this point.

Once the bolt 100 has been moved to its firing position and released therefrom via the actuation of the trigger 140, the bolt 100 is forcefully urged along its firing path and the firing pins 106, 108 and 114 are urged toward their respective spears 54. The reason that the firing pin distances 110, 112 and 116 have been varied as described above is to effect the early arrival of the primary firing pin 106 at the launch position of the spear 54 in the primary firing chamber 36 that is in the firing position. That is, the first firing pin 106, supported on the extending portion 102 of the bolt 100, ignitingly impacts the spear 54 in the primary firing chamber 36 in its firing path prior to the arrival of the auxiliary firing pin 108 that is supported on the extending portion 104 of the bolt 100. With the ignition of the first spear that has been ignited (in the primary firing chamber 36 in the firing path), the spear emits spear propulsion gases, and the combination of the spear propulsion gases and the impact of the primary firing pin 106 with the ignited spear absorb the movement of the bolt 100, thereby serving to brake the movement of the bolt 100 to prevent simultaneous firing impact of the auxiliary firing pin 108 with a spear in the auxiliary firing chamber 38 that is positioned in the firing path of the bolt 100. The end 103 of the extending portion 102 serves as a reaction face against which the propulsion forces of the ignited spear impact.

Since the bolt 100 has been braked in its movement toward the propulsion units of the spears in the magazine 14 by the ignition of a spear in the primary firing chamber 36 before the auxiliary firing pin 108 can ignitingly impact a spear, it should be clear that only one spear will be ignited with a single actuation of the trigger 140. It should be noted that the bolt 100 is returned to its rest position via the coordinated action of the trigger 140 and the bolt return member 160 in order to again place the spear gun 10 in a mode that permits continued operation. As the trigger 140 is moved in the actuating direction 184, the trigger 140 bears against the trigger engaging member 166 to pivot the bolt engaging member 164 such that the bolt return member 160 is clear of the firing path of the bolt 100. With the return of the trigger 140 in the direction 186, the biasing of the bolt return member 160 in the direction 168 urges the bolt engaging member 164 in contact with the bolt 100 to return the bolt 100 to its rest position as shown in FIG. 3.

With continued actuation of the trigger 140, another primary firing chamber 36 is positioned in the firing path of the bolt 100. As long as there is a spear in the primary firing chamber that is sequenced to assume the firing position, the auxiliary firing pin 108 will be prevented from ignitingly impacting a spear in the auxiliary firing chamber in the firing position. Once the supply of spears in the primary firing chambers 36 has been exhausted by sequentially firing of these spears, the firing of the spears in the auxiliary firing chambers 38 will commence. That is, as the bolt 100 is forcefully urged by the spring 122 along its firing path, it will continue to travel in this path until braked by the igniting of a spear. Therefor, if no spear is in the primary firing chamber 36 positioned in the firing position, the bolt 100 will continue to travel until the auxiliary firing pin 108 ignitingly impacts a spear. In like manner to that described above, the ignited spear in the auxiliary firing chamber 38 will brake the movement of the bolt 100 by exerting reaction forces against the end 105 of the extending portion 104 of the bolt 100. Since the second firing pin distance 112 is less than the third firing pin distance 116, the combined force of the reaction gases and the impact with the spear in the auxiliary firing chamber 38 will occur prior to the arrival of the third firing pin 114, thus preventing igniting impact between the third firing pin 114 and a spear in the axial firing chamber 40.

In the same manner and for the same reason as discussed for the sequencing of spear ignition in the firing chambers 36, all of the spears in the auxiliary firing chambers 38 will be sequentially ignited prior to the ignition of a spear in the axial firing chamber 40. Once the supply of spears is exhausted in the primary and auxiliary firing chambers 36, 38, further actuation of the trigger 140 will again cause the bolt 100 to be forcefully urged toward the magazine 14, and since no braking action will occur against the primary and auxiliary firing pins 106, 108, the extending portions 102 and 104 will simply be free to enter the bores of the respective primary and auxiliary firing chambers 36 and 38 positioned as a radial set in the firing position, and the third firing pin 114 will be free to ignitingly impact with a spear in the axial firing chamber 40, finally exhausting the last spear in the magazine 14.

DESCRIPTION OF FIG. 4

Figure 4:
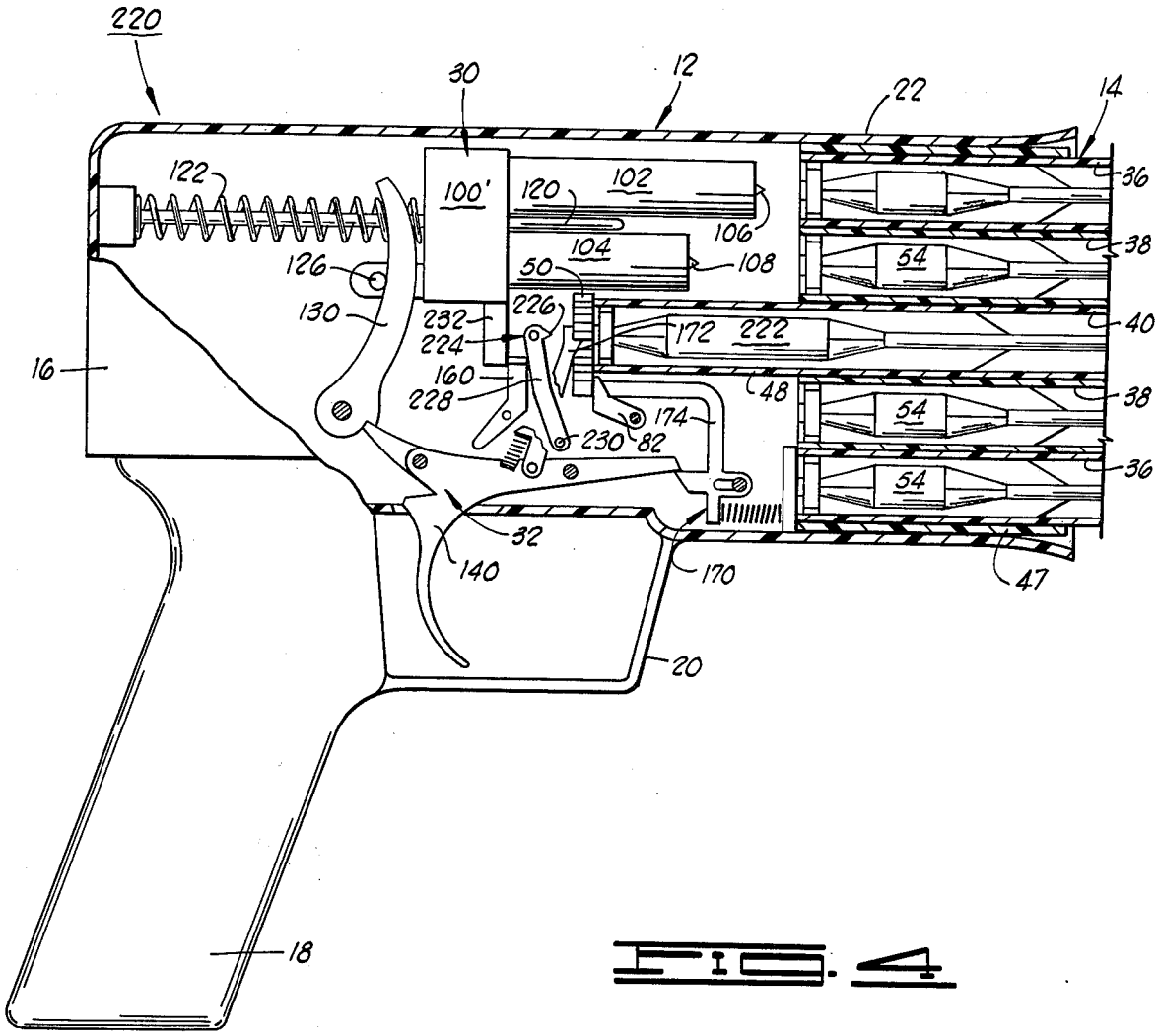
FIG. 4 is a side elevational, partial cutaway view of another embodiment of a spear gun constructed in accordance with the present invention.

FIG. 4 shows an alternative embodiment of a repeating spear gun constructed in accordance with the present invention. The spear gun 220 of FIG. 4 is identical in construction detail to the spear gun 10 that has been described above with the exceptions that will be explained below. Therefore, in the interest of brevity, like components in FIG. 4 will be numbered with the same numeral designations used above for the spear gun 10 of FIGS. 1–3.

The spear gun 220 differs from the spear gun 10 in that the third firing pin, the firing pin associated with the axial firing chamber 40, is indepenent to the bolt assembly 30. That is, this firing pin is not mounted on the bolt 100, but is individually mounted and actuated. The reason for this feature is to provide the spear gun 220 with the capability of firing ammunition contained in the axial firing chamber 40 at any selected time, regardless of the load condition of the other firing chambers. This permits the dedication of the axial firing chamber 40 to a different purpose than that of the other firing chambers. For example, the axial firing chamber 40 might be used as a barrel for land type ammunition, or for a more powerful spear to provide for emergency conditions. Therefor, the spear gun 220 will be described with a spear 222 loaded in the axial firing chamber 40. The spear 222, for convenience, will be the same generally as the spears 54 and need not be explained further.

As shown in FIG. 4, the gear engaging member 172 is only partially depicted in order to reveal the details of an axial firing pin assembly 224. The axial firing pin assembly 224 comprises an axial firing pin 226 that is mounted on a hammer member 228 which is in turn pivotally supported via a pivot pin 230 on the housing 16. The axial firing pin is disposed to be forcefully urged against and ignite the propulsion unit of the spear 222 disposed in the axial firing chamber 40 by means of a spring (not shown).

The axial firing pin assembly 224 may be provided with a trigger assembly similar to the trigger assembly 32, but in the preferred form, it is thought best to simply provide a lever attachment (not shown) that extends external to the housing 16 and which may be manually manipulated. That is, the lever attachment to the hammer 228 would extend through a slot in the wall of the housing 16 and the spear 222 would be ignited by the simple action of manually retracting the hammer and releasing the lever to permit the forceful urging of the hammer forward to bring the axial firing pin 226 into igniting impact with the spear 222. Of course, a conventional safety mechanism may be utilized to prevent inadvertent actuation of the firing pin assembly 224.

Another change made in the spear gun 220 may be found in the difference of the bolt 100' thereof as compared to the bolt 100 of the spear gun 10. The bolt 100' is constructed identically to the bolt 100 with the exception that the lower portion of the bolt 100' has been reduced in thickness to permit the free clearance of the hammer member 228 as it is retracted. Accordingly the bolt 100' has an extending tab 232 that is disposed to the free side of the hammer member 228, the tab 232 providing contacting engagement with the bolt return member 160 for the return of the bolt 100' to its rest position following actuation by the trigger assembly 32.

With the exception that the above described axial firing pin assembly 224 is actuated independently, the operation of the spear gun 220 is identical to that of the spear gun 10, and further discussion of the operation of the spear gun 220 need not be provided herein.

As mentioned above, the primary use of the repeating spear gun of the present invention will be as an underwater weapon. Therefore, the materials of construction should be selected to prevent or minimize the corrosive effects of the weapon environment. Accordingly, it is desirable that many of the parts be constructed of polymeric plastics that are also capable of withstanding the mechanical and thermal stresses that are generated in the operation of the spear gun. Otherwise, the use of coated metal parts is recommended, such as, for example, by chrome or nickel platings.

It is clear that the present invention provides an underwater weapon having the capability for firing a plurality of spears prior to the need of reloading, and that in achieving this object, a simple mechanism is afforded for sequencing the order in which the spears are launched. Further, the present invention achieves the object of utilizing the exhaust gas of self-propelled spears to sequence the firing order of spears in an underwater weapon.

Thus the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A repeating spear gun for launching self-propelled spears, comprising:

a breech; a magazine connected to the breech in an assembled mode of the speargun and comprising:

a primary firing chamber containing a spear in a loaded condition thereof, said spear retainingly positionable at a launching position in the primary firing chamber; and an auxiliary firing chamber containing a spear in a loaded condition thereof, said spear retainingly positionable at a launching position in the auxiliary firing chamber;

a bolt supported by the breech for movement toward the magazine and having a rest position and a firing position, the bolt characterized as comprising:

a primary firing pin mounted on the bolt and disposed to be positionable by movement of the bolt in striking engagement with a spear in the primary firing chamber in the loaded condition thereof, the primary firing pin disposed by the bolt a predetermined first firing pin distance from the launching position of the primary firing chamber when the bolt is in the rest position; and an auxiliary firing pin mounted on the bolt and disposed to be positionable by the movement of the bolt in striking engagement with a spear in the auxiliary firing chamber in the loaded condition thereof, the auxiliary firing pin disposed by the bolt a predetermined second firing pin distance from the launching position of the auxiliary firing chamber when the bolt is in the rest position; and biasing means supported by the breech for forcefully urging the bolt toward the magazine along the firing path when the bolt is moved to the firing position and released therefrom, the first firing pin distance being greater than the second firing pin distance so that the primary firing pin is caused to strike and fire a spear in the primary firing chamber in the loaded condition thereof whereupon spear propulsion gases and spear impact absorb the movement of the biasing means to prevent simultaneous firing impact of the auxiliary firing pin with a spear in the auxiliary firing chamber, and so that the auxiliary firing pin is caused to strike and fire a spear in the auxiliary firing chamber in the loaded condition thereof when no spear is in the primary firing chamber.

2. The spear gun of claim 1 further comprising:

trigger means for moving the bolt to the firing position and for releasing the bolt thereat.

3. The spear gun of claim 2 further comprising:

chamber indexing means responsive to the trigger means for rotating the magazine to position the primary firing chamber and the auxiliary firing chamber in the firing path of the bolt.

4. The spear gun of claim 3 wherein the magazine is further characterized as comprising:

an axial firing chamber containing a spear in a loaded condition thereof, said spear retainingly positionable at a launching position in the axial firing chamber; and wherein the bolt is further characterized as comprising:

an axial firing pin mounted on the bolt and disposed to be positioned by movement of the bolt in striking engagement with a spear in the axial firing chamber in the loaded condition thereof, the axial firing pin disposed by the bolt a predetermined third firing pin distance from the launching position of the axial firing chamber when the bolt is in the rest position, the third firing pin distance being greater than the second firing pin distance so that the axial firing pin is caused to strike and fire a spear in the axial firing chamber in the loaded condition thereof only when no spear is in the primary firing chamber and in the auxiliary firing chamber.

5. The spear gun of claim 3 wherein the magazine is further characterized as comprising:

an axial firing chamber containing a spear in a loaded condition thereof, said spear retainingly positionable at a launching position in the axial firing chamber; and wherein the speargun further comprises:

axial firing pin means supported by the breech for striking and firing a spear in the axial firing chamber; and bias means for activating the axial firing pin means to effect the striking and firing of the spear in the axial firing chamber.

6. A repeating spear gun for launching spears having integral propulsion mechanisms ignitable by mechanical impact, comprising:

a breech;

a launching tube assembly connected to the breech in an assembled mode of the spear gun, the launching tube assembly comprising a plurality of firing tubes, each firing tube having a rear end disposed substantially adjacent the breech in the assembled mode of the spear gun and each firing tube containing, in a loaded condition thereof, a spear having a propulsion mechanism positionable substantially adjacent the rear end of the firing tube, the launching tube assembly selectively positionable to dispose at least two selected firing tubes simultaneously in a firing position;

bolt means supported by the breech and characterized as comprising a plurality of firing pins, each firing pin supported on a respective reaction face, for impacting one firing pin against and igniting the propulsion mechanism of one spear prior to such impact between another firing pin and propulsion mechanism so that the force of the exhaust gas of the ignited propulsion mechanism and the impact with the ignited spear will exert upon the reaction face associated with the impacted firing pin a braking force to prevent sufficient impact between another firing pin and a propulsion mechanism to effect ignition of any other spear; and biasing means supported by the breech for urging the bolt means toward the propulsion mechanism.

7. The spear gun of claim 6 wherein the launching tube assembly is characterized as further comprising:

an axial firing chamber containing a spear in a loaded condition thereof, said spear retainingly positionable at a launching position in the axial firing chamber; and wherein the spear gun further comprises:

axial firing pin means for striking and firing a spear in the axial firing chamber; and bias means for activating the firing pin means to effect the striking and firing the spear in the axial firing chamber.

8. A repeating spear gun for launching self-propelled spears, comprising:

a breech;

a magazine supported by the breech in an assembled mode of the spear gun and comprising:

a plurality of primary firing chambers, each containing a spear in a loaded condition thereof, each said spear retainingly positionable at a launching position in its respective primary firing chamber; and a plurality of auxiliary firing chambers equal in number to the number of primary firing chambers, one each of said auxiliary firing chambers radially aligned with one of the primary firing chambers to form therewith a radial set of firing chambers, each of said auxiliary firing chambers containing a spear in a loaded condition thereof, each spear retainingly positionable at a launching position in its respective auxiliary firing chamber;

a bolt supported by the breech for movement toward the magazine and having a rest position and a firing position, the bolt characterized as comprising:

a primary firing pin mounted on the bolt and disposed to be positionable by movement of the bolt in striking engagement with a spear disposed in a primary firing chamber positioned in the firing path of the bolt, the primary firing pin disposed by the bolt a predetermined first firing pin distance from the launching position of the primary firing chamber positioned in the firing path when the bolt is in the rest position; and an auxiliary firing pin mounted on the bolt and disposed to be positionable by movement of the bolt in striking engagement with a spear disposed in an auxiliary firing chamber positioned in the firing path of the bolt, the auxiliary firing pin disposed by the bolt a predetermined second firing pin distance from the launching position of the auxiliary firing chamber positioned in the firing path when the bolt is in the rest position; and biasing means supported by the breech for forcefully urging the bolt toward the magazine along the firing path when the bolt is moved to the firing position and released therefrom, the first firing pin distance being greater than the second firing pin distance so that the primary firing pin is caused to ignitingly impact a spear in the primary firing chamber positioned in the firing path in the loaded condition thereof whereupon spear propulsion gas and spear impact absorb the movement of the bolt to prevent simultaneous firing impact of the auxiliary firing pin with a spear in the auxiliary firing chamber position in the firing path, and so that the auxiliary firing pin is caused to ignitingly impact a spear in said auxiliary firing chamber when no spear is in a primary firing chamber.

9. The spear gun of claim 8 further comprising:

trigger means for moving the bolt to the firing position and for releasing the bolt thereat.

10. The spear gun of claim 9 further comprising:

chamber indexing means responsive to the trigger means for rotating the magazine to position a radial set of firing chambers in the firing path of the bolt, a different radial set of chambers being positioned in the firing line of the bolt with each actuation of the trigger means.

11. The spear gun of claim 10 wherein the magazine is further characterized as comprising:

an axial firing chamber containing a spear in a loaded condition thereof, said spear retainingly positionable at a launching position in the axial firing chamber; and wherein the bolt is further characterized as comprising:

an axial firing pin mounted on the bolt and disposed to be positioned by movement of the bolt in striking engagement with a spear in the axial firing chamber in the loaded condition thereof, the axial firing pin disposed by the bolt a predetermined third firing pin distance from the launching position of the axial firing chamber when the bolt is in the rest position, the third firing pin distance being greater than the second firing pin distance so that the axial firing pin is caused to ignitingly impact a spear in the axial firing chamber in the loaded condition thereof only when no spear is in any primary firing chamber and when no spear is in any auxiliary firing chamber.

12. The spear gun of claim 10 wherein the magazine is further characterized as comprising:

am axial firing chamber containing a spear in a loaded condition thereof, said spear retainingly positionable at a launching position in the axial firing chamber; and wherein the spear gun further comprises:

firing pin means for ignitingly impacting a spear in the axial firing chamber; and bias means for activating the firing pin means to ignite the spear in the axial firing chamber.

* * * * *